US005655685A

United States Patent [19]

Carr et al.

[11] Patent Number: 5,655,685

[45] Date of Patent: Aug. 12, 1997

[54] CLOSURE ASSEMBLY FOR A CONTAINER HAVING A TAMPER-EVIDENT POURING SPOUT CLOSURE MEMBER

[75] Inventors: Joseph J. Carr, Point Pleasant, N.J.; Thomas J. Angelini, Pittsfield, Mass.

[73] Assignee: Clayton Corporation, Fenton, Mo.

[21] Appl. No.: 456,172

[22] Filed: May 31, 1995

[51] Int. Cl.[6] ..... B67D 5/33

[52] U.S. Cl. ..... 222/153.02; 222/153.06; 222/525

[58] Field of Search ..... 222/153.02, 153.06, 222/153.07, 153.09, 153.1, 153.14, 524, 525; 215/252, 253, 258

[56] References Cited

U.S. PATENT DOCUMENTS 4,500,016 2/1985 Funfstuck ..... 222/153.14
4,625,875 12/1986 Carr et al. ..... 215/252
4,948,003 8/1990 Munoz ..... 215/253
5,072,863 12/1991 Stull ..... 222/525
5,104,008 4/1992 Crisci ..... 222/525
5,472,120 12/1995 Stebick et al. ..... 222/525

*Primary Examiner*—Philippe Derakshani
*Attorney, Agent, or Firm*—Louis E. Marn

[57] ABSTRACT

There is disclosed a tamper-evident closure member for a pouring spout of a tamper-evident closure assembly for a bottle and/or container wherein the closure member is formed with interlocking shoulder/flange members of closure member/pouring spout as well as a ring member positionable within a channel of the pouring spout and having an orifice or orifices in fluid communication with an interior chamber of the pouring spout.

5 Claims, 1 Drawing Sheet

CLOSURE ASSEMBLY FOR A CONTAINER HAVING A TAMPER-EVIDENT POURING SPOUT CLOSURE MEMBER

BACKGROUND OF THE INVENTION

1. Field of the Invention

This invention relates to tamper-evident closures for a container, and more particularly, to a tamper-evident closure assembly having a tamper-evident pouring spout closure member.

2. Brief Description of the Prior Art

Sport bottles and/or containers have gained an increasing share of the marketplace. Closure assemblies of the prior art are described inter alia in U.S. Pat. Nos. 4,500,016, 4,948,003 and 5,104,008 (to be reviewed).

Currently available closure members having pouring spouts are often inadequate, and are not leak-proof. For example, in U.S. Pat. No. 5,104,008 to Crisci, there is disclosed a closure member with a pouring spout which is pulled down over the pouring spout with the hope that in a closed position of the closure member to pouring spout, there is no leakage between the plug and cooperating central opening.

OBJECTS OF THE PRESENT INVENTION

An object of the present invention is to provide a tamper-evident closure member for a pouring spout of a tamper-evident container closure assembly for a container achieving leakage proof interrelation between the tamper-evident closure member and pouring spout.

Another object of the present invention is to provide a tamper-evident closure assembly for a pouring spout on a tamper-evident closure for a container.

Yet another object of the present invention is to provide a leak-proof pull-push spout assembly formed of poor dimensional instable plastic.

SUMMARY OF THE INVENTION

These and other objects of the present invention are achieved by a tamper-evident closure member for a pouring spout of a tamper-evident container closure assembly for a bottle and/or container wherein interlocking cooperation is provided between an inner shoulder of the pouring spout closure member with an interlocking shoulder of the pouring spout and wherein a ring member formed on the pouring spout closure member is positionable within a channel of the pouring spout having an orifice or orifices in fluid communication with an interior chamber of the pouring spout.

BRIEF DESCRIPTION OF THE DRAWINGS

A better understanding of the present invention as well as other objects and advantages thereof will become apparent upon consideration of the detailed disclosure thereof, especially when taken with the accompanying drawings, wherein.

DETAILED DESCRIPTION OF THE DRAWINGS

Figure 1:
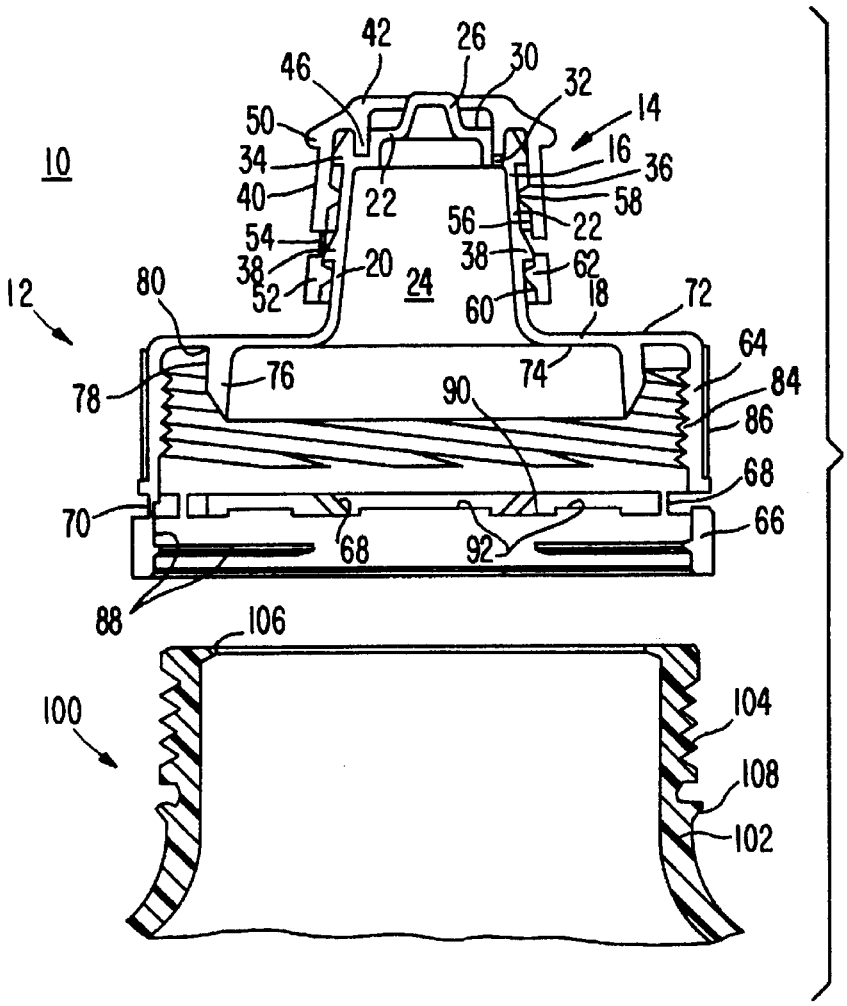
FIG. 1 is an elevational view of the tamper-evident container closure assembly of the present invention positioned above a neck of a container therefor.
Figure 2:
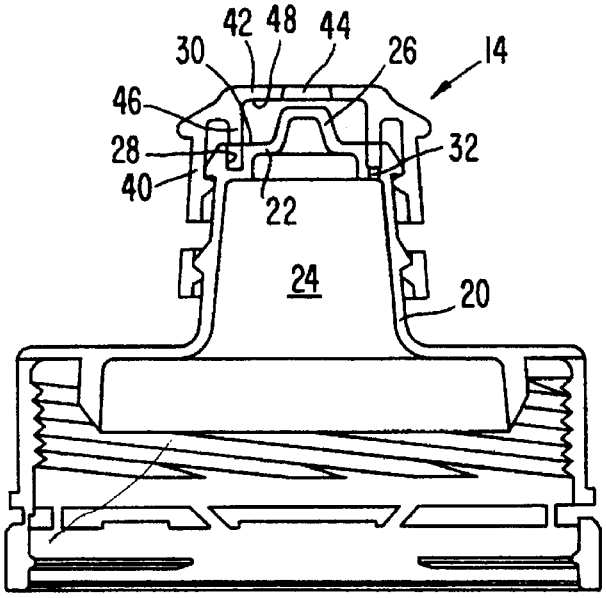
FIG. 2 is a cross-sectional view of the tamper-evident pouring spout closure member in an open position on the pouring spout of the tamper-evident container closure member.

Referring to the drawings and particularly FIG. 1, there is illustrated a tamper-evident container closure assembly, generally indicated as 10, comprised of a tamper-evident container closure member, generally indicated as 12, and a tamper-evident pouring spout closure member, generally indicated as 14, positioned on a pouring spout 16 extending upwardly from an end wall 18 of the tamper-evident container closure member 12.

Figure 3:
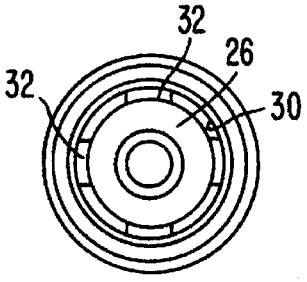
FIG. 3 is a partial top elevational view of the pouring spout of the tamper-evident container closure assembly of the present invention.

The pouring spout 16 is comprised of a generally cylindrically-shaped side wall 20 extending upwardly from the end wall 18 of the closure member 12 to a top end wall portion 22 defining an interior chamber 24. Formed upwardly from the top end wall portion 22 and centrally positioned thereto, there is provided a conically-shaped plug portion 26. The top end wall portion 22 is formed with a circularly-shaped channel 28 extending downwardly from a top surface 30 peripherally about the end wall portion 22. A plurality of elongated orifices 32, referring to FIG. 3, are provided at the bottom of the channel 28 providing fluid communication to the chamber 24 of the pouring spout 16. The top end wall portion 22 is formed with an outwardly extending annular flange 34. The side wall 22 is formed with a lower outwardly extending annular shoulder 38, as more fully hereinafter described.

The pull-push pouring spout closure member 14 includes a cylindrically-shaped side wall portion 40 extending upwardly to a top end wall portion 42 having a centrally-formed opening 44 therein. The top end wall portion 42 is formed with an annular ring 46 extending downwardly from an inner surface 48 thereof. The annular ring 48 is sized to provide frictional fitting interrelationship within the annular channel 28 of the pouring spout 16 as more fully hereinafter discussed. The top end wall portion 42 proximate the cylindrically-shaped side wall 40 is formed with an outwardly extending flange 50. The side wall portion 40 is connected to a tamper-evident ring 52 by a plurality of radially disposed frangible elements 54 (one shown). An inner surface 56 of the side wall 40 is provided with an inwardly extending annular shoulder 58. An inner surface 60 of the tamper-evident ring 52 is provided with an inwardly extending annular shoulder 62.

The tamper-evident container closure member 12 includes a closure portion similar to the closure member disclosed in U.S. Pat. No. 4,625,875, assigned to the same assignee as the present invention, and hereby incorporated by reference. The closure member 12 of the closure assembly 10 is comprised of the upper end wall 18 including pouring spout 16 from which downwardly depends a cylindrically-shaped side wall 64 and a ring-shaped tamper-evident skirt member 66 depending from the cylindrically-shaped side wall 64 by a plurality of frangible arm members 68. The frangible arm members 68 are angularly-disposed with reference to a center axis of the closure member 12 thereby forming a ring-shaped opening 70 between the cylindrically-shaped side wall 64 and the tamper-evident skirt member 66.

The closure assembly 10 is formed of a suitable thermoplastic material, such as low density polyethylene or like thermoplastic materials possessing certain characteristics of flexibility, as will hereinafter become more apparent. The arm members 68 are configured and angularly disposed to provide a spring-like action between the skirt member 66 and the side wall 64 of the container closure member 14 of the closure assembly 10.

The end wall 18 of the closure 10 is formed with an outer surface portion 72 and an inner surface portion 74 including a cylindrically-shaped internal centering element 76 depending inwardly essentially coincident to the cylindrically-shaped side wall 64 to facilitate centering on a container as more fully hereinafter discussed. An outer surface portion 78 of the internal centering element 76 proximate the inner surface portion 74 of the end wall 18 is provided with a groove 80. The cylindrically-shaped side wall 64 is formed with an internal thread 84 and with a knurled or serrated outer surface portion 86 to facilitate in closure member removal and closure member tightening about a container as more fully hereinafter discussed.

The tamper-evident skirt member 66 is formed with an inwardly extending annular shoulder 88, as more fully hereinafter discussed. The external diameter of the skirt member 66 is substantially equal to the external diameter of the closure member 12, and essentially equal to the external diameter of a knurled portion 86 of the closure member 12 thereby simplifying bottling assembly requirements. An upper surface portion 90 of the skirt member 66 is formed with a plurality of wall sections 92 extending partially upwardly into the opening 70.

In operation, the tamper-evident pouring spout closure member 14 is disposed over the pouring spout 16 and with a downward force, the pouring spout closure member 14 is caused to be downwardly displaced onto the pouring spout 16 to a point where the shoulder 58 of the upper side wall portion 40 and the shoulder 62, respectively, are positioned beneath shoulder 36 and 38 of the pouring spout 16, respectively. During such downward movement, the annular ring member 46 is caused to be positioned within the channel 28 of the pouring spout 16 in frictional engagement thereby sealing the orifices 32 between the closure member 14 and the chamber 24 of the pouring spout 16. In such position, the tamper-evident ring 52 affixed by the frangible elements 54 to the side wall portion 40 of the pouring spout closure member 14 evidencing integrity to the pouring spout 16.

The closure member 10 cooperates with container, generally indicated as 100 (e.g., a 16 oz. bottle containing water, sports beverages or the like), referring particularly to FIG. 1, including a neck portion of 102, including external threads 104, an inwardly extending lip portion 106 on an inner portion thereof and a skirt ridge or collar 108 formed on an extended surface thereof.

The internal threads 84 of the container closure member 12 and the external threads 104 of the container 100 are preferably of the multiple thread type whereby the container closure member 16 assumes a level position of substantially coaxial alignment with the axis of the container 100 when disposed on the neck 102 of the container 100. After such positioning, a downward longitudinal force is applied to the closure assembly 10 thereby to cause the closure member 10 to be displaced onto the neck 102 of the container 100, i.e., the container closure member 12 is pushed onto the neck 102 of the container 100 to a point where the annular shoulder 88 formed on the skirt member 66 overrides with the ridge or collar 108 formed on the neck 102 of the container 100. During such downward movement of the container closure portion, the wall sections 92 of the skirt member 66 contact the lower surface portion of the side wall 64 to drive the skirt member 66 into the tamper-evident mode, i.e., the container closure member 12 may not now be removed from the container 100 without fracturing the frangible arm members 68. Removal of the container closure portion from the container 10 retains the tamper-evident skirt member 66 about the neck portion 102 of the container 100. Additionally, the inwardly extending lip 106 cooperates with groove 80 of the closure 10 to provide for additional closure integrity between the closure 10 and the container 100, particularly for uses relating to carbonate beverage bottling.

Consequently, after assembly onto a container, container and pouring spout integrity are ensured by the existence of intact frangible elements 68 between the side wall 64 and skirt member 66 of the container closure member 12 and the existence of intact frangible elements 54 between the side wall portion 40 and skirt member 52 of the pouring spout closure member 16.

An upward force on lower surface portion of the annular flange 50 of the pouring spout closure member 14, such as by finger pressure, causes the frangible elements 54 to fracture as a result of contact between the shoulder 62 of the skirt member 52 with the shoulder 38 of the pouring spout 16 thereby causing the skirt member 52 to remain positioned about a lower neck portion of the pouring spout 16. The side wall section 40 of the pouring spout container member 12 continues in upward movement until arrested by contact of the shoulder 58 thereof with the annular flange 34 of the pouring spout 16 with concomitant fluid access to the chamber 24 of the pouring spout 16 via the orifices 32 and a fluid passage formed between the top surface 30 of the pouring spout 16 and a lower surface of the end wall portion 42 of the pouring spout closure member 14 thence through the opening 44.

Positive closing of the pouring spout closure member 14 on the pouring spout 16 is effected by pushing the pouring spout closure member 14 downwardly on the pouring spout 16 to a point where the shoulder 58 overrides and is positioned in interlocking relationship with shoulder 36 of the pouring spout 16. Concomitant frictional engagement exists between the annular ring 46 of the pouring spout closure member 16 within the channel 28 of the pouring spout 16. Data frictional fitting is achieved by forming the annular ring 46 of thickness slightly greater, e.g., 0.020 mm greater than the width of the annular channel 28.

Once the container 100 requires refilling, it is necessary to destroy the integrity of the container closure member 12 with the container 100 which is effected by counterclockwise rotation of the container closure member 12 about the neck portion 102 of the container 100 to a point where the frangible arm members 68 are fractured thereby leaving the tamper-evident ring 66 disposed about the neck portion 102 of the container 100. Turning of the container closure member 12 about the container 100 is continued to the point of removal of the closure assembly 10 from the container 100 thereby permitting refilling of the container 100 with any preselected liquid. After refilling, the closure assembly 10 may be repositioned by twisting on the container 100 with the pull-push pouring spout closure member 14 cooperating with the pouring spout 16 of the closure assembly as hereinafter discussed.

While the present invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed:

1. A tamper-evident closure assembly which comprises:

a container closure member having a pouring spout formed at an end wall thereof, said pouring spout including a cylindrically-shaped side wall and a top wall defining a chamber, said top wall formed with an annular channel including orifice means in fluid communication with said chamber, said cylindrically-shaped side wall of said pouring spout having an outwardly extending annular flange formed about an upper portion thereof and with an outwardly extending annular flange about a lower portion; and a pouring spout closure member disposed in pull-push relationship on said pouring spout of said container closure member, said pouring spout closure member including a cylindrically-shaped side wall and a top end wall having an opening therein, said top end wall formed with an annular ring portion for cooperating with said annular channel of said pouring spout, said annular ring portion of said pouring spout closure is of a thickness greater than a width of said annular channel of said pouring spout/said cylindrically-shaped side wall of said pouring spout closure member connected by frangible elements to a tamper-evident ring opposite, said top wall thereof, an inner surface portion of said cylindrically-shaped side wall of said pouring spout closure member formed with an inwardly extending flange for cooperating in opened/closed relationship with said upper outwardly extending annular flange, an inner surface of said tamper-evident ring formed with an in turned ring to engage said lower outwardly extending flange of said pouring spout to cause said frangible elements to fracture upon upward pulling of said pouring spout closure member from said pouring spout of said container closure member.

2. The tamper-evident closure assembly as defined in claim 1 wherein said annular ring is in frictional interrelationship with said annular channel when said pouring spout closure member is in closed relationship to said pouring spout member.

3. The tamper-evident closure assembly as defined in claim 1 for use in connection with a container including a threaded neck portion and an annular collar portion below said threaded neck portion wherein said container closure member is formed of a one-piece closure body including an upper closure portion comprised of said end wall and a cylindrical side wall, said cylindrical side wall including an internally threaded upper portion, a depending lower skirt portion, and arm members formed between said closure body and said lower skirt portion defining an opening therebetween, said depending lower skirt portion including an inwardly projecting bead adapted to engage said inwardly projecting bead portion of said container when said closure is positioned in fluid tight relationship to said containers, said arm members being fracturable to thereby leave said depending lower skirt portion on said container after said upper closure portion of said closure is unthreaded from said container.

4. The tamper-evident closure as defined in claim 3 wherein said upper closure portion is formed with intermediate wall portions depending downwardly into said opening in said spaced-apart relationship to said depending lower skirt portion.

5. The tamper-evident closure as defined in claim 4 wherein said threaded neck portion of said container and said internally threaded upper portion of said closure is formed of a multiple thread type.

* * * * *